US005097112A

United States Patent [19]

Kanaya et al.

[11] Patent Number: 5,097,112

[45] Date of Patent: Mar. 17, 1992

[54] OVEN

[75] Inventors: Yoshihiro Kanaya; Makoto Morishima, both of Nagoya, Japan

[73] Assignee: Rinnai Kabushiki Kaishi, Japan

[21] Appl. No.: 524,199

[22] Filed: May 16, 1990

[30] Foreign Application Priority Data

May 19, 1989 [JP] Japan ..... 1-138674[U]

[51] Int. Cl.[5] ..... H05B 3/62

[52] U.S. Cl. ..... 219/411; 219/413; 219/506

[58] Field of Search ..... 219/405, 411, 393, 408, 219/412, 413, 506

[56] References Cited

U.S. PATENT DOCUMENTS 4,238,995 12/1980 Polster ..... 219/411
4,317,025 2/1982 Starnes ..... 219/408
4,345,145 8/1982 Norwood ..... 219/408

*Primary Examiner*—Teresa J. Walberg
*Attorney, Agent, or Firm*—Nilsson, Robbins, Dalgarn, Berliner, Carson & Wurst

[57] ABSTRACT

An oven with an oven chamber (2) provided at a front opening with a door (3) which can be opened and closed. The oven chamber (2) is provided with a halogen lamp (4), which halogen lamp (4) is arranged such that the output thereof reduced upon opening of the door (3).

2 Claims, 2 Drawing Sheets

OVEN

BACKGROUND OF THE INVENTION

1. Field of the Invention

An oven using a halogen lamp as a heat source is conventionally known from JP-B-34426/1988.

While a halogen lamp is effective in scorching a material being cooked and the like, and also effective for lighting the oven chamber, it has a disadvantage in that it is so bright that it hurts the eyes if it is directly looked at.

SUMMARY OF THE INVENTION

This invention has an object of providing an oven without this kind of disadvantage.

In order to solve this kind of problem this invention is characterized by an oven comprising an oven chamber provided at a front opening with a door which can be opened and closed, the oven chamber being provided with a halogen lamp, wherein the halogen lamp is arranged such that the output thereof is largely dropped in interlocking with the opening of the door.

In the oven having the above-mentioned construction, it is possible to largely drop the output of the halogen lamp in interlocking with the opening of the door and, therefore, the lamp is not too bright to the eyes when the door is open.

BRIEF DESCRIPTION OF THE DRAWINGS

An embodiment of this invention is described with reference to the drawings in which.

DESCRIPTION OF THE PREFERRED EMBODIMENT

Figure 1:
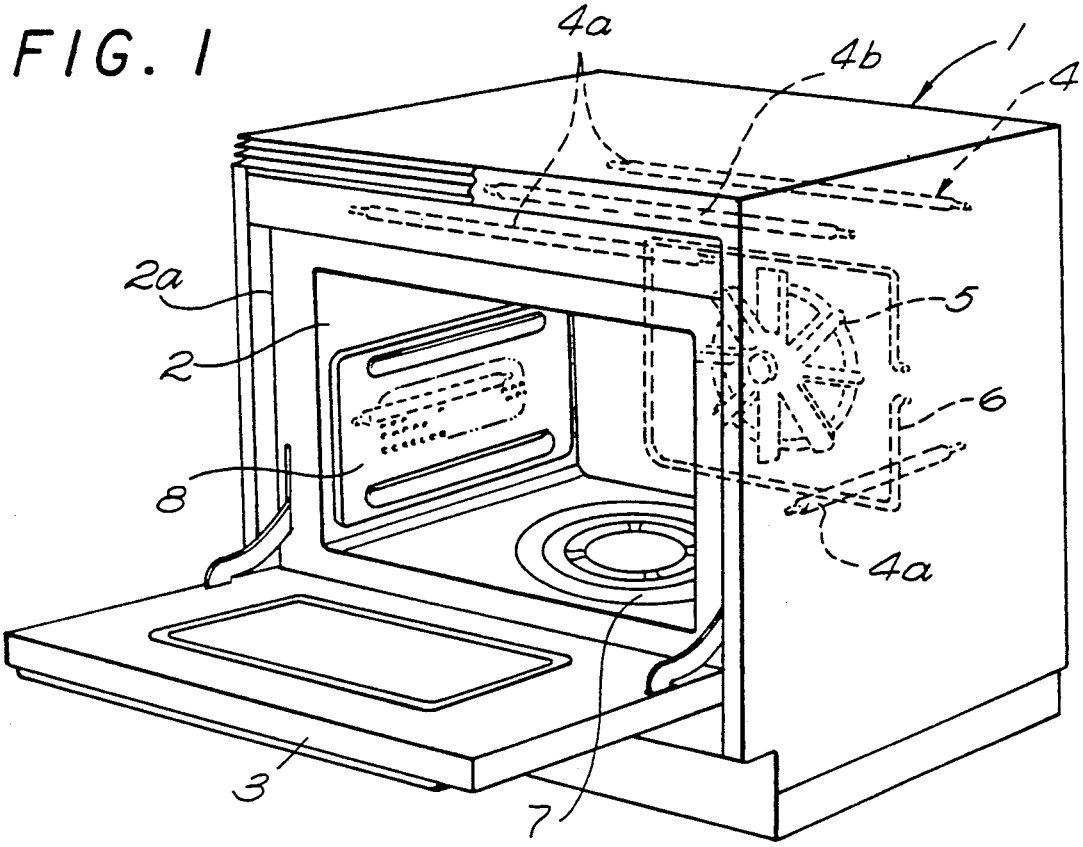
FIG. 1 is a perspective view of an embodiment of this invention.
Figure 2:
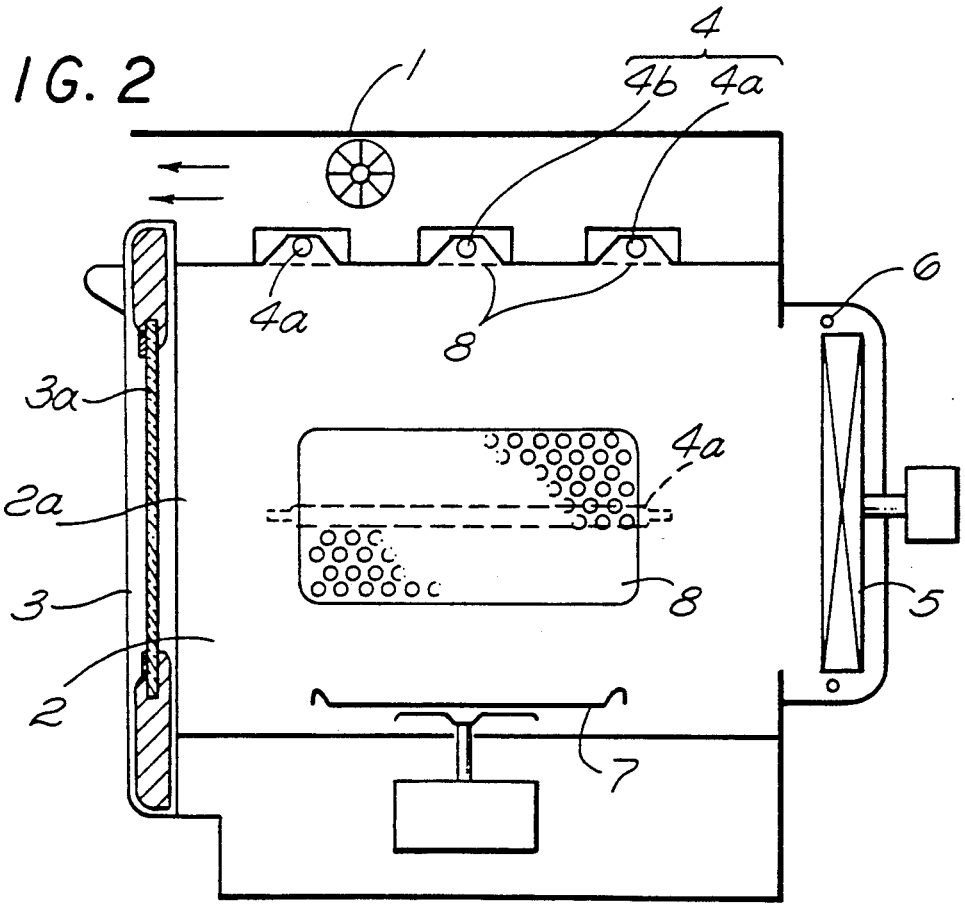
FIG. 2 is a sectional side view thereof.

Referring to the drawings, there are shown an oven main body 1, an oven chamber 2 provided in the oven main body 1, a door 3 which is provided at an opening 2*a* in a front of the oven chamber and which can be opened and closed. The door 3 is provided, at the centre of a frame 3*b*, with a glass plate 3*a*. Halogen lamps 4 are disposed in the oven chamber 2, a fan 5 is disposed inside the chamber in the rear thereof, a sheath heater 6 is so disposed as to enclose the fan 5 inside the oven chamber, and a turntable 7 is disposed at the bottom of the oven chamber 2. A transparent or frosted bright halogen lamp 4*b* is disposed in the centre of the ceiling of the oven chamber 2 so as to scorch (brown) the material being cooked as well as to brightly light the inside of the chamber. Dim halogen lamps 4*a* are provided. They have on their surfaces a far infrared coating, and are disposed on the ceiling in front of and at the back of the halogen lamp 4*b* as well as on both sides of the chamber 2 so that cooking may be performed by far infrared rays from the halogen lamp 4*a*.

Figure 3:
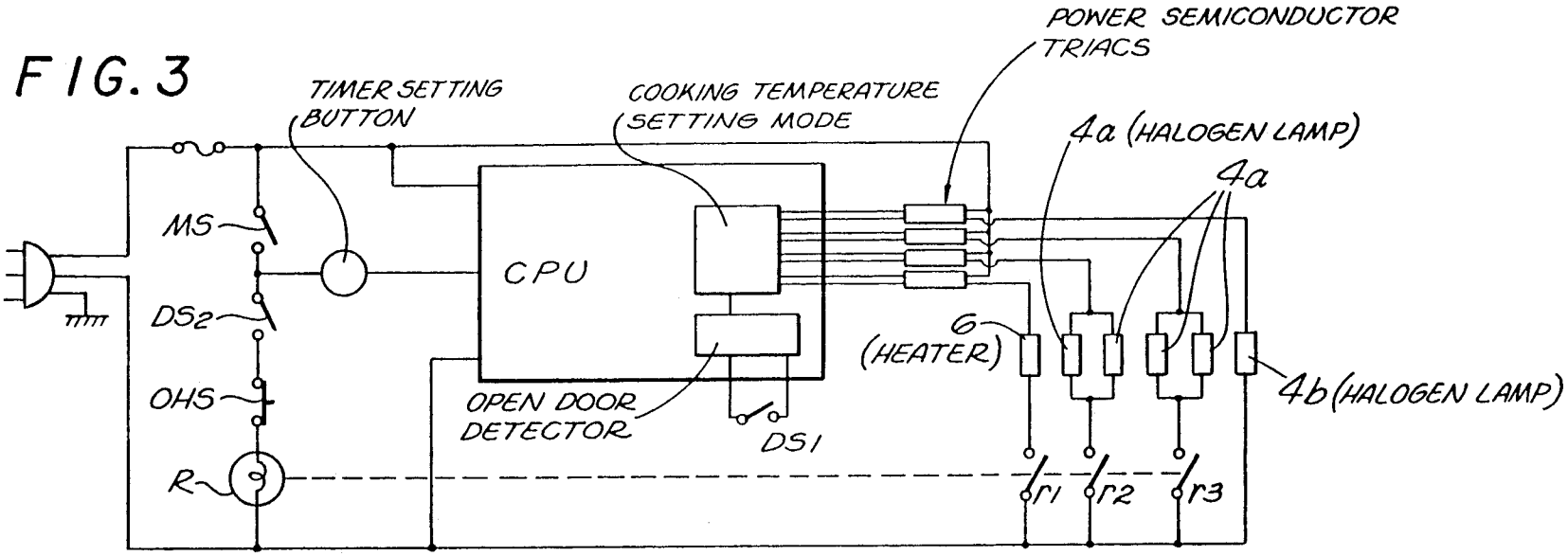
FIG. 3 is a control circuit diagram.

The halogen lamp 4*b* is so arranged that its output is reduced in an interlocking relationship with the opening of the door 3. Further explanation is made with reference to FIG. 3, in which a CPU has the function of detecting a switch DS1 which opens in an interlocking relationship with the opening of the door 3. Thus, when the CPU has detected the opening of the switch DS1 in an interlocking relationship with the opening of the door 3, the output of the halogen lamp 4*b* is reduced. Namely, if the output in an ordinary scorching cooking is 700W, for example, the output of the lamp is switched to 50W which corresponds to 1/14 of the total output. In other words, during cooking, the output of the halogen lamp 4*b* is 700W, corresponding to its full output with the door closed. At this time, since the door is kept closed, the light of the halogen lamp 4*b* hardly reaches directly to the eyes due to the frame 3*b* of the door 3. Alternatively, if the door 3 is provided with light-shielding meshes, the light is reduced and is not glaring to the eyes.

However, if the door is opened under full output, the light directly reaches the eyes and is glaring.

Therefore, it is so arranged that, when the door is opened during cooking under full output of the halogen lamp 4*b*, the output thereof is reduced to 50W which corresponds to 1/14 of the total output and which is not glaring to the eyes even if its light directly reaches the eyes. Further, when the door 3 is opened after the cooking has finished, i.e. when the halogen lamp 4*b* has been switched off, the CPU operates to light the halogen lamp 4*b* at 50W which corresponds to 1/14 of the total output, based on the information that the cooking has finished and that the door 3 is open. The reference character MS denotes a main switch provided in the circuit which connects the CPU to a power source. In this circuit the other halogen lamps 4*a* provided with a far infrared coating and the sheath heater 6 disposed in the rear of the oven chamber 2 are controlled by the CPU, as well as by relay contacts r1, r2 and r3 of a relay R which is controlled by the main switch MS, the door switch DS2 and by a normally closed switch OHS to be opened in an interlocking relationship with an overheating prevention device.

Figure 4:
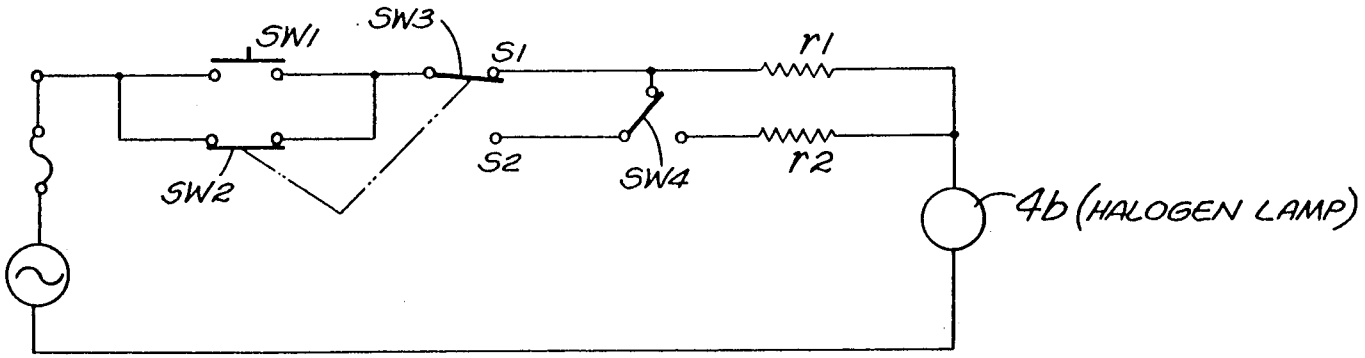
FIG. 4 is another control circuit diagram.

FIG. 4 shows an operation circuit of another embodiment, in which the lamp 4*b* is connected to the power source through (i) a time switch SW1 to set the time for cooking, (ii) a make and break switch SW2 which is interposed in parallel with the timer switch SW1 and which is closed when the door 3 is opened, and (interposed in series with these switches) a resistor r1 of high resistance value which is connected to the first contact S1 of a change-over switch SW3 which is connected when the door 3 is opened, the change-over switch being changed over in an interlocking relationship with the opening of the door 3; and (iii) a resistor r2 of low resistance value which is connected to the second contact S2 which is connected when the door 3 is closed. Further, there is interposed, between the second contact S2 and the resistance r2, a change-over switch SW4 which is changed over between the resistor r1 and the resistor r2 depending on the kind of cooking.

As to the kinds of cooking, the oven can perform various kinds of cooking such as yeast fermentation (baking), oven cooking, grill cooking, heating cooking, defrosting and drying. In this respect, the resistor r2 and the second contact S2 are connected by means of the change-over switch SW4 only in grill cooking, and, in the other kinds of cooking the resistor r1 is connected to the second contact S2. Accordingly, when other kinds of cooking are performed, the halogen lamp 4*b* a small output of 50W exclusively for lighting purpose irrespective of whether the door 3 is opened or closed.

Although punched plates 8 are provided in front of the lamps 4*a*, 4*b* to protect the lamps from mechanical shocks, they have little or no effect of shielding the light.

Since this invention has the above-mentioned construction, the output of the halogen lamps can be reduced in an interlocking relationship with the opening of the door, and the lamps are not glaring to the eyes when the door is opened.

We claim:

1. An oven comprising an oven chamber provided at a front opening with a door which can be opened and closed, said oven chamber being provided with a halogen lamp operable to provide low and high outputs of light, and means responsive to opening of the door for reducing the output of said halogen lamp from said high level to said low level.

2. An oven according to claim 1, comprising a switch which opens in an interlocking relationship with the opening of the door, and a CPU which causes said reduced output upon detection of the opening of said switch.

* * * * *